United States Patent [19]

Koziol et al.

[11] Patent Number: 4,460,450

[45] Date of Patent: Jul. 17, 1984

[54] COATED VALVE METAL ANODE FOR THE ELECTROLYTIC EXTRACTION OF METALS OR METAL OXIDES

[75] Inventors: Konrad Koziol, Röthenbach; Erich Wenk, Nuremberg, both of Fed. Rep. of Germany

[73] Assignee: Conradty GmbH & Co. Metallelektroden KG, Röthenbach, Fed. Rep. of Germany

[21] Appl. No.: 465,250

[22] Filed: Feb. 9, 1983

[30] Foreign Application Priority Data

Mar. 12, 1982 [DE] Fed. Rep. of Germany ..... 3209138

[51] Int. Cl.[3] ..... C05B 11/00; C05C 7/02

[52] U.S. Cl. ..... 204/290 F

[58] Field of Search ..... 204/290 F

[56] References Cited

U.S. PATENT DOCUMENTS

| | | | |
|---|---|---|---|
| 3,671,415 | 6/1972 | King | 204/290 F |
| 3,907,659 | 9/1975 | Paige | 204/290 F |
| 4,260,470 | 4/1981 | Fisher | 204/290 F |

*Primary Examiner*—John F. Niebling

*Attorney, Agent, or Firm*—Lyon & Lyon

[57] ABSTRACT

A coated valve metal anode for the electrolytic extraction of metals or metal oxides, comprising a current-carrying component, e.g. a current lead and/or a current distributor, which consists of a jacket of valve metal and a core arranged therein made of a metal which is a good conductor.

In order to prevent as far as possible the internal ohmic voltage loss in the case of such an electrode, in the core metal of the current-carrying component a contact structure is embedded which is preferably made of valve metal and is connected by a plurality of welds with the inner surface of the jacket.

19 Claims, 19 Drawing Figures

FIG.1
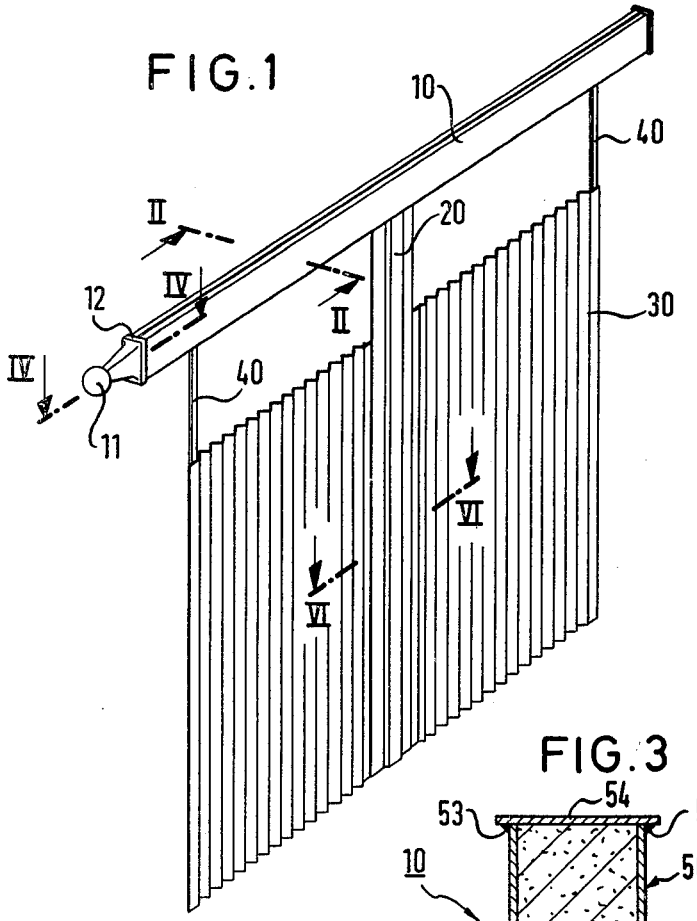
FIG.3
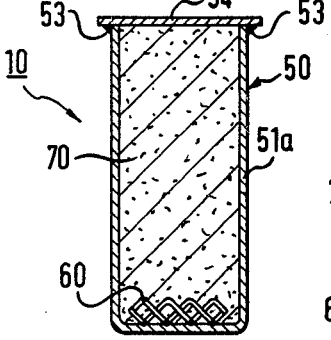
FIG.5
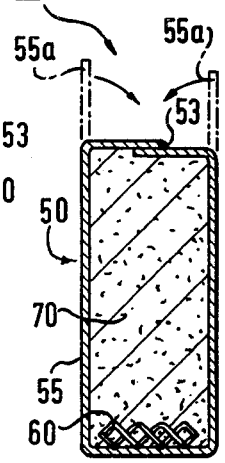
FIG.2
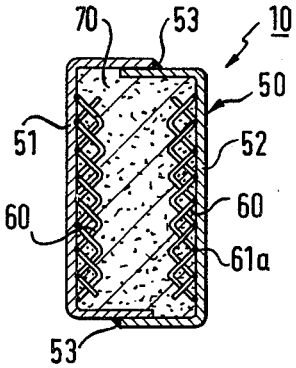
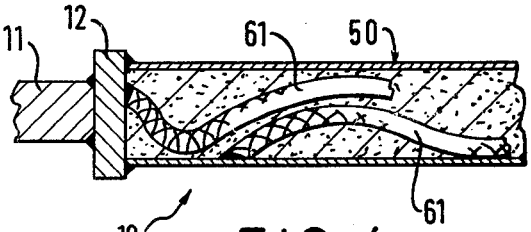
FIG.4

COATED VALVE METAL ANODE FOR THE ELECTROLYTIC EXTRACTION OF METALS OR METAL OXIDES

The present invention relates to an electrode, e.g. an anode of coated valve metal, for the electrolytic extraction of metals or metal oxides.

Coated metal anodes of this type used in the field of the electrolytic extraction of metals, e.g. of nonferrous metals from the acidic solutions containing the metal to be extracted, often replace the anodes originally used of lead or lead alloys or of graphite. The working surface of these coated metals consists of a supporting core of a valve metal, such as for example titanium, zirconium, niobium, or tantalum, on which is applied a coating of an anodically active material, e.g. the metals of the platinum group or platinum metal oxide. The substantial advantage of the metal anodes is saving of electrical energy compared with the conventional lead or graphite anodes. The energy saving results from the larger surface attainable with coated metal anodes, the high activity of the coating and the form stability. This energy saving makes possible a considerable reduction of the anode voltage. Coated metal anodes produce a further operational saving in that cleaning and neutralisation of the electrode is facilitated, since the coating of the anodes is not destroyed by $Cl^-$, $NO_3^-$ nor by free $H_2SO_4$. An additional saving in costs results from the fact that when using coated metal anodes, the electrolyte does not have to be treated with expensive additives, such as cobalt or strontium carbonate such as is necessary when using lead anodes. Further pollution of the electrolyte and of the metal extracted by lead, which cannot be prevented when using lead anodes, is avoided. Lastly, coated metal anodes permit an increase in the current density and thus in productivity.

When designing these coated metal anodes various differing methods have been chosen.

In a known metal anode of the type in question (German Offenlegungsschrift No. 24 04 167) the important design criterion is regarded as being that the anode surface opposite the cathode is from 1.5 to 20 times smaller than the cathode surface and the anode is accordingly operated at a current density which is 1.5 to 20 times greater than the cathode current density. Due to these measures it is said that in an economic manner a relatively pure metal deposit of the desired crystalline structure and purity is obtained on the cathode. The economy of the known anode evidently consists of the fact that because of the reduced surface of the anode against the cathode, the use of materials for the production of the anode is reduced and thus expensive valve metal material is saved. But the cost reduction in the manufacture of this anode is achieved at the price of not insubstantial disadvantages. One of these disadvantages is that the anodic share of the cell voltage is high, because the anode is operated with high current density. This causes the important disadvantage of high energy consumption for the cells equipped with such an anode. The large current density and the smaller conductive cross-section of the known anode due to the reduced active surface and thus the smaller volume of material bring about a large internal ohmic voltage drop, with consequent further increase in the electrical energy needed. In order to remove the disadvantage of the large internal ohmic voltage drop, the profiled rods arranged parallel to each other, which form the active surface, consist of a jacket of titanium, which is provided with a core of copper. The current lead and distributor rails have a comparable construction. They are arranged in an intricate manner to attain a major shortening of the current routes in the small active surface of the anode. The intricate design of the profiled rods forming the active surface as well as the necessary lengthy current lead and distributor rails increase this cost of the known design substantially.

In another known coated metal anode (German Offenlegungsschrift No. 30 05 795), in order to avoid the basic disadvantage of the coated metal anode described above, a totally different design route has been followed in that the active surface of this anode is very large due to the fact that the rods spaced in one plane from each other and parallel to each other, which form the active surface, accord with a relationship whereby the total surface of the rods $F_A$ and the surface occupied by the total arrangement of the rods $F_P$ is $$6 \geqq F_A/F_P \geqq 2.$$

This anode construction, preferably made of pure titanium, has no further current lead and distributor apart from the main current lead rail. The current transport in the vertical direction is however performed exclusively by the rods of valve metal. On the whole this anode, due to the large-scale active surface, has proven to be excellent in many electrolytic metal extraction processes.

The internal ohmic voltage drop of titanium anodes is desirably to be reduced in view of rising kilowatt/hr prices, and this demands the use of larger conductive cross-sections for the current-carrying components of this expensive metal. In designing the active surface of titanium rods arranged in one plane parallel to each other, a correspondingly large cross-section must be provided in order to be able to match the internal ohmic voltage drop which occurs with the thick, massive lead anodes, which in turn reduces the technical and cost advantages of the valve metal anodes.

With the current conductor and distributor rails already mentioned consisting of a core of copper and a surrounding jacket of titanium, the aim is to achieve a "metallurgical compound" between the metal of the core and the metal of the jacket. The decline of the internal voltage drop which is supposed to be attained by the design of the core of one metal with good electrical conductivity is in fact only attained if the current transfer to the coated active portion is ensured by a large-area and trouble-free metallurgical compound between the material of the jacket and the material of the copper. But this precondition is only achieved with very high manufacturing costs. Nevertheless this current conductor has proved itself for anodes in chloralkali analysis according to the diaphragm process. The temperature sensitivity of the metallurgical compound between copper and titanium presupposes however that in the event of recoating of these DIA anodes, the titanium-sheathed copper rod will be separated from the active portion to be coated.

In connection with an anode for chloralkali electrolysis (British Pat. No. 1,267,985) current leads and current distributors have become known in which the jacket of titanium is filled with a core of aluminum or of an aluminum alloy. The electrically conductive connection between the metal of the core and the metal of the jacket is to be achieved by a diffusion layer of an alloy, which is formed between the core metal and the jacket metal surrounding it. Although great value is placed on the exact pouring of the jacket of titanium with the core metal in the fluid state, it cannot be excluded that the core metal, when solidifying, will shrink so far that either no diffusion layer is formed between the core metal and the jacket metal, or a diffusion layer already formed breaks again, with the result that at least in some areas gaps occur between the core metal and the jacket metal. This leads naturally to a high voltage drop on transfer of the current from the core metal to the jacket metal.

These problems have long been known with current-carrying components, such as current leads and current distributors, in the case of graphite anodes.

Thus a graphite electrode using metallic current supply has become known for chloralkali electrolysis (German Offenlengungsschrift No. 15 71 735) in which the current transfer metal-graphite is performed by mercury and/or an amalgam which is liquid at external temperature. This is to ensure a good electrical contact between the metal and graphite, since contraction strains do not occur.

This development has also been pursued in the case of metal electrodes. In one known metal electrode for electrolysis apparatus for the electrolytic production of chlorine (German Offenlegungsschrift No. 27 21 958) at least the primary conductor rails consist of tube inside which metal rods are arranged, which are embedded in a current conducting material which is predominantly liquid at operating temperatures. This current conducting material can consist of low melting point metals or alloys such as Wood's metal, Rose's metal or Lipowitz metal, sodium, potassium or their alloys or another current conducting material such as metal oxides or graphite, which can be impregnated with metal alloys.

These solutions have the drawback that the electrical conductivity is relatively low and at low operating temperatures of the metal extraction process at least many of these materials are not in a liquid state. Moreover the contact metals form crusts over the long periods of use which are normal with electrodes.

This history makes it clear that it is a substantial problem to produce a good electrically conductive connection between the core metal and the jacket metal of current-carrying components.

It is an object of the invention to provide an electrode which causes relatively low internal voltage drop during long periods in use.

A further object of the invention is to provide an electrode which can be cheaply and economically manufactured.

Another object of the invention is to provide an electrode distinguished by a high degree of operational safety.

A yet further object of the invention is to provide an electrode which can easily be inserted in the active portions of coated metal anodes so that a relatively flat metal anode results.

According to the invention, there is provided an electrode for the electrolytic extraction of metals or metal oxides, having an electrically conductive member which comprises a jacket of metal; a core of metal which is a good electrical conductor arranged in electrically conductive connection with said jacket; and a metallic contact structure which is embedded in the core metal, and is connected by welding to an inner surface of said jacket.

Embodiments of an electrode according to the invention will now be described by way of example with reference to the accompanying drawings, in which:

FIG. 1 shows the basic design of an electrode according to the invention;

FIG. 2 shows a section through the current conductor of the electrode according to FIG. 1 along the sectional line II—II;

FIG. 3 shows a section through another embodiment of a current conductor;

FIG. 4 shows a longitudinal section through the current conductor of the electrode of FIG. 1 along the sectional line IV—IV;

FIG. 5 shows a further embodiment of a current conductor;

Figure 6:
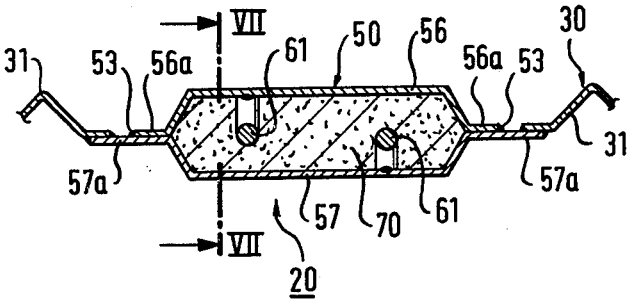
FIG. 6 shows a horizontal section through the active surface of the electrode of FIG. 1 along the sectional line VI—VI with a separate current distributor.

FIG. 1 shows the basic assembly of a coated metal anode according to the invention. This electrode consists of a horizontally extending current lead 10. On the bottom of this current lead, approximately in the middle, a vertically extending current distributor 20 is attached. This current distributor 20 is connected with the active portion 30, i.e. the active surface of the electrode. For stiffening of especially the vertical marginal areas of the active portion 30, they are connected with the current lead 10 by stiffening struts 40.

FIG. 2 shows a vertical section through the current lead 10 of FIG. 1. Accordingly, the current lead 10 consists of a jacket 50, which is composed of two U-profiles 51 and 52, which partly overlap with their free legs and are interconnected in these areas by welded seams 53. The jacket 50 consists of a valve metal, preferably titanium. On the two opposite inner surfaces of said jackets 50, respective strips 60 of an expanded metal of the same valve metal as the jacket, i.e. titanium, is welded by a plurality of welds 61*a*. The result is both a firm mechanical connection as well as a good electrically conductive connection between the respective strips 60 of expanded metal and the sleeve 50. In the cavity of the jacket is filled a core 70 of a suitable non-valve metal which is a good electrical conductor. When filling in, the core metal 70 flows round the strips 60 of expanded metal on all sides and shrinks when solidifying closely onto the surface of the strips 60 of expanded metal. This produces a close mechanical and good electrically conductive connection between the core metal 70 and the strips 60 of expanded metal. The strips 60 of expanded metal thus constitute the desired contact structure.

The strips 60 of expanded metal extend parallel to the current flow in the current feed 10, from a terminal head 11 of the current lead 10 at least to the point where the current distributor 20 branches off. If it is desired that a part of the current should also flow via the stiffening strips 40 on the right in FIG. 1, it is advisable that the strips 60 of expanded metal should extend into the area of the branching point of this stiffening strip 40.

FIG. 3 shows a cross-section of a somewhat modified form of the current lead 10 of the electrode in FIG. 1. In this case the jacket 50 of the current lead 10 consists of a U-shaped profile 51*a* and a flat terminal strip 54. The two parts 51*a* and 54 of jacket 50 are interconnected at their impact points by welded seams 53. On the lower internal surface of the jacket 50 there is a strip 60 of expanded metal which forms the contact structure and for this purpose is cast round by the core metal 70 and welded with the internal surface of the jacket 50.

FIG. 5 shows a current lead 10 with an integral jacket 50. To manufacture this embodiment, a U-profile 55 has welded on its lower internal surface a strip 60 of expanded metal. Then the core metal 70 is filled in to a height which corresponds with the height of the inner cross-section of the final form of the jacket of the current lead 10. The free legs 55*a* of the U-profile 55 are then bent inwards as indicated in FIG. 5 and by the application of a welded seam 53 are made gastight and proof against leaks of liquid.

FIG. 4 shows in longitudinal section the current lead 10 of the electrode in FIG. 1. But in this case there is a somewhat differently assembled contact structure. It consists in fact of two wires 61 which are disposed in approximately the direction of the current flow, but in sinuous form in the interior of the jacket 50. The wires 61 contact at intervals the inner surfaces of the jacket 50 and are welded to them. One of the wires 61 can be welded with its end facing the terminal head 11 to an intermediate plate 12, in order in this way to attain a direct transfer of the current from the terminal head 11 via the intermediate plate 12 onto one of the wires 61 of the contact structure formed thereby.

FIG. 6 shows a horizontal section through the current distributor 20 of the electrode according to FIG. 1 along the sectional line VI—VI. From FIG. 6 it can be seen that the current distributor 20 is integrated in the active portion. The active portion 30 can for example consist of two plates 31 extending on both sides from current distributor 20, while said plates 31 are designed to enlarge the surface and the stiffness in the form of a corrugated sheet. The current distributor 20 itself consists of a jacket 50, which is composed of two U-profiles 56 and 57, and the longitudinal flanges 56*a* and 57*a* are welded together by welded seams 53. The two plates 31 of the active portion 30 are also welded with the flanges 57*a*.

In the cavity formed by the jacket 50 are provided wires 61 disposed sinuously in the direction of the current flow, forming the contact structure. The cavity is filled up by an appropriate core metal 70.

Figure 7:
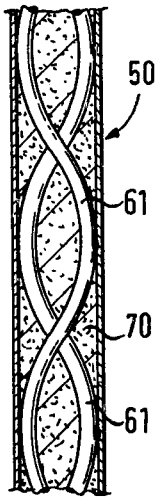
FIG. 7 shows a section through the current distributor of the electrode of FIG. 6 along the sectional line VII—VII.

As can be seen from FIG. 7, the sinuously disposed wires 61 contact at intervals the internal surface of the jacket 50 of the current distributor 20 and are welded at these points, preferably on one side only, with the jacket 50.

Figure 8:
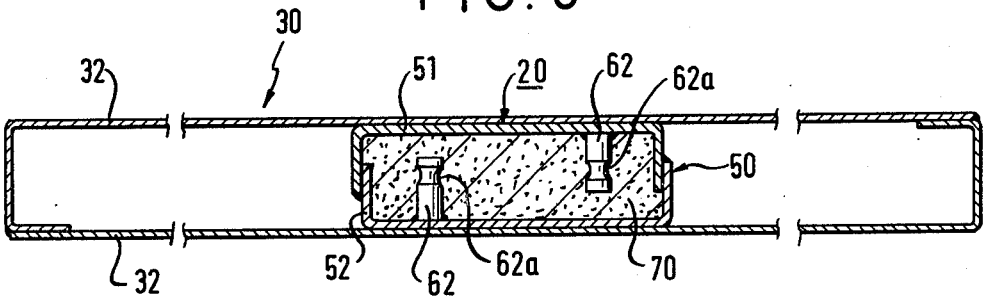
FIG. 8 shows a horizontal section through a further embodiment of an electrode according to the invention.

FIG. 8 shows in horizontal section a so-called box electrode in which the active portion 30 is formed by two expanded grid sheets 32 which together form a hollow profile in whose interior the current distributor 20 extends. This current distributor has a jacket 50 which corresponding to FIG. 2 consists of two members having U-shaped cross-section 51 and 52 on which the sheets 32 are welded. The cavity of the jacket 50 is filled up with a suitable core metal 70. The contact structure consists of pins 62 which respectively have one or more thinned regions or constrictions 62*a*.

Figure 9:
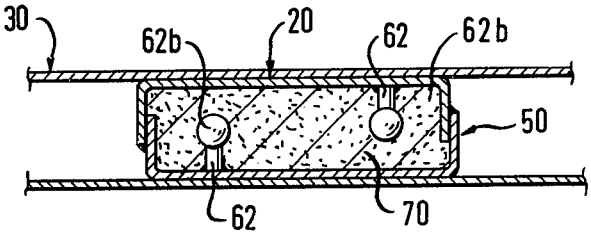
FIG. 9 shows also a horizontal section through a further embodiment of an electrode according to the invention.

FIG. 9 shows an electrode arrangement which is substantially comparable to FIG. 8. But in the design according to FIG. 9 the pins 62 forming the contact structure have terminal thickenings 62*b*.

Figure 11:
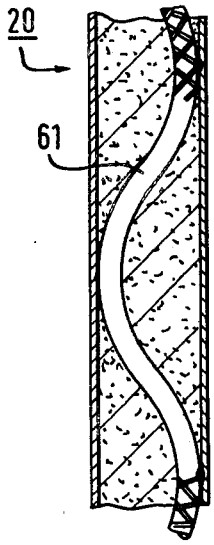
FIG. 11 shows a section through the electrode of FIG. 10 along the sectional line IX—IX.
Figure 10:
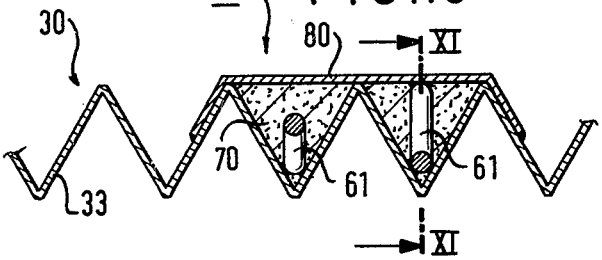
FIG. 10 shows a horizontal section through the active surface of a further embodiment of an electrode according to the invention, in which a current distributor is integrated in the active portion.

FIGS. 10 and 11 show an electrode with current distributor integrated in the active portion. In this electrode the active portion 30 and/or the active surface consists of a corrugated plate profile 33. To form the current distributor 20 a wire 61 is disposed sinuously in two adjacent corrugated troughs respectively and preferably, forming the contact structure. The core metal 70 is filled in these two corrugated troughs. This area of the corrugated plate profile 33 of the active portion 30 then forms a part of the jacket of the current distributor 20. The jacket is closed by a cover plate 80 which covers the two corrugated troughs, which is angled corresponding to the corrugated form of the corrugated plate profile 33 and is welded in the area of its distortions with the corrugated plate profile 33.

Figure 12:
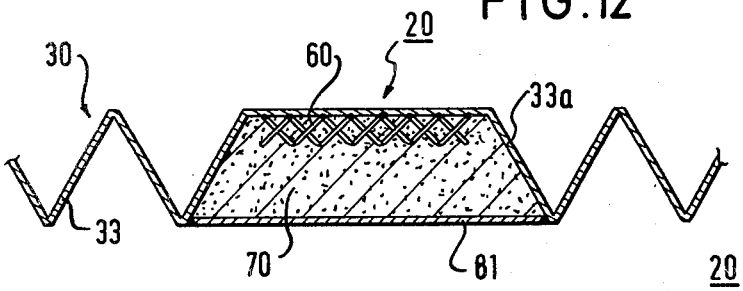
FIG. 12 shows a horizontal section through the active surface of a further embodiment of an electrode according to the invention in which also a current distributor is integrated in the active portion.

A similar design of the active portion 30 is shown in FIG. 12, with integrated current distributor 20. In this case the corrugated plate profile 33 has a U-shaped area which is broader than the other corrugations, and which serves as a part of the jacket of the current distributor 20. On the inside of the area 33*a* of the corrugated plate profile 33 is placed a strip 60 of expanded metal as the contact structure, which is welded with the corrugated plate profile 33 at a plurality of points. The U-shaped area 33*a* of the corrugated plate profile 33 forms jointly with a cover plate 81, which is suitably welded with the corrugated plate profile 33, a cavity into which the core metal 70 is filled.

Figure 13:
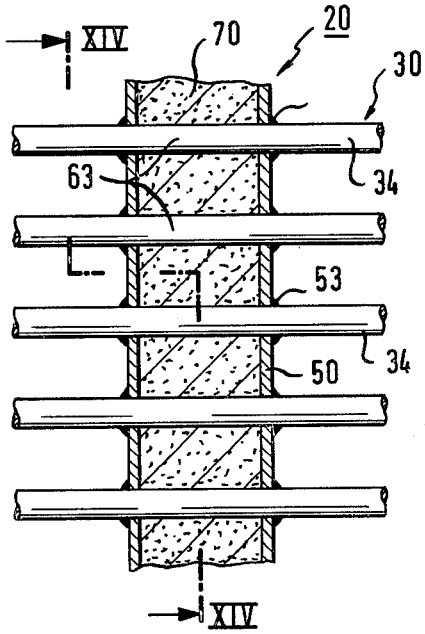
FIG. 13 shows a vertical section through a further embodiment of an electrode according to the invention.
Figure 14:
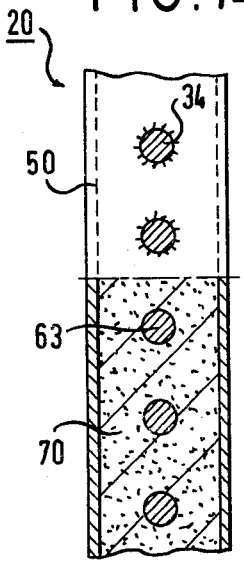
FIG. 14 shows a view of the electrode along the line XIV—XIV of FIG. 13.

A basically different embodiment of an electrode is shown in FIGS. 13 and 14. Here the active portion 30 of the electrode consists of profiled rods 34 arranged in one plane at intervals and parallel to each other. The profile of these rods 34 is not critical. In the case shown the rods are of circular cross-section. The current distributor 20 comprises a tubular jacket 50 having two rows of radial bores oppositely located, through which the profiled rods 34 are inserted. The profiled rods 34 are connected mechanically and as electrical conductors by welded seams 53 with the tubular jacket 50 of the current distributor 20. A suitable core metal 70 fills the tubular jacket 50. The sections 63 of the profiled rods within the tubular jacket 50 of the current distributor 20 form the contact structure. These sections 63 can have a corresponding form or surface form or a contact coating in order to attain the aim of a close shrinking of the core metal 70 onto these sections of the profiled rods 34.

Figure 15:
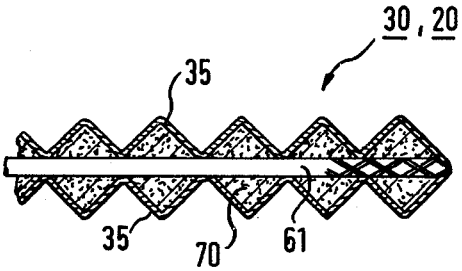
FIG. 15 shows a section through a further embodiment of an electrode according to the invention.
Figure 16:
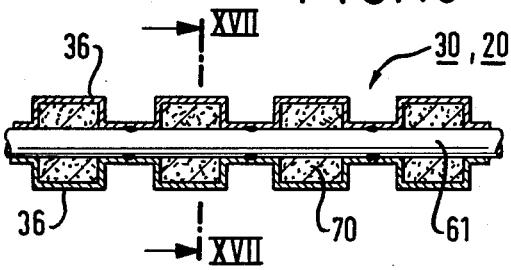
FIG. 16 shows a section through a further embodiment of an electrode according to the invention.
Figure 17:
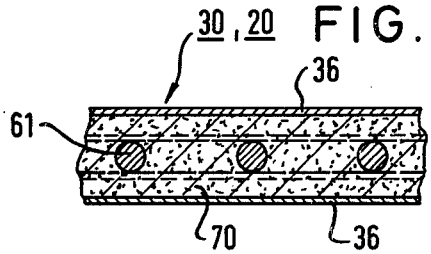
FIG. 17 shows a section through the electrode of FIG. 16 along the sectional line XVII—XVII.

FIGS. 15 to 17 show a further basic embodiment of a metal electrode. Here the active portion 30 is formed by two oppositely disposed corrugated plate profiles 35 or 36, which together form a cavity. Whereas the corrugated plate profile 35 of FIG. 15 has a zig-zag form, the corrugated plate profile 36 of FIG. 16 is composed of U-shaped portions. In the cavity between the two corrugated plate profiles 35 and 36, wires 61 are inserted as the contact structure and are welded at intervals with the corrugated plate profiles 35 and 36. The remainder of the cavity between the two corrugated plate profiles 35 and 36 is filled with a suitable core metal 70. Thereby the current-carrying component 20 results.

Figure 18:
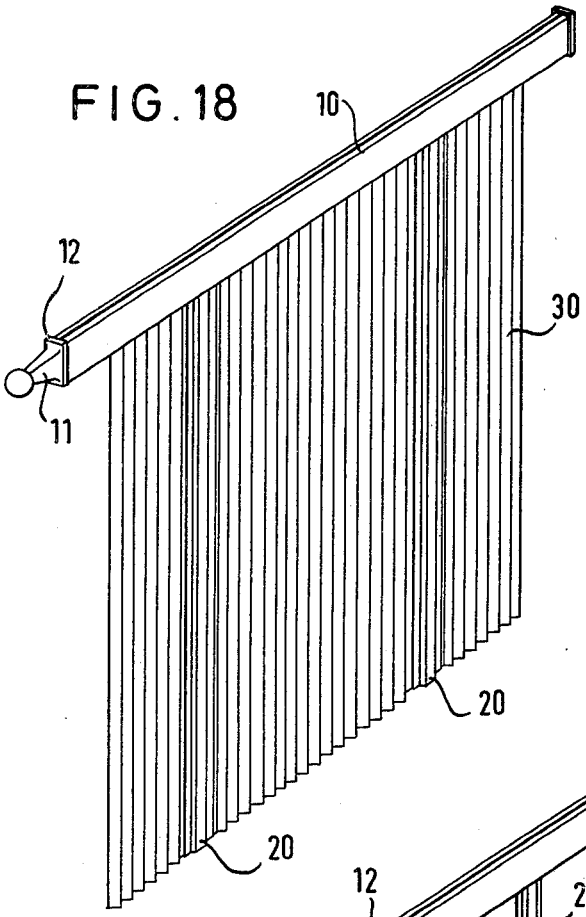
FIG. 18 shows a perspective view of a further electrode according to the invention.

FIG. 18 shows an electrode in which two current distributors 20 are integrated in the active portion 30 corresponding to the design possibilities above. The active portion 30 extends up to the bottom of the current lead 10 and is connected therewith. In this case it is recommended that the contact structure in the interior of the current lead 10 should extend substantially over the entire length of the active portion 30.

Figure 19:
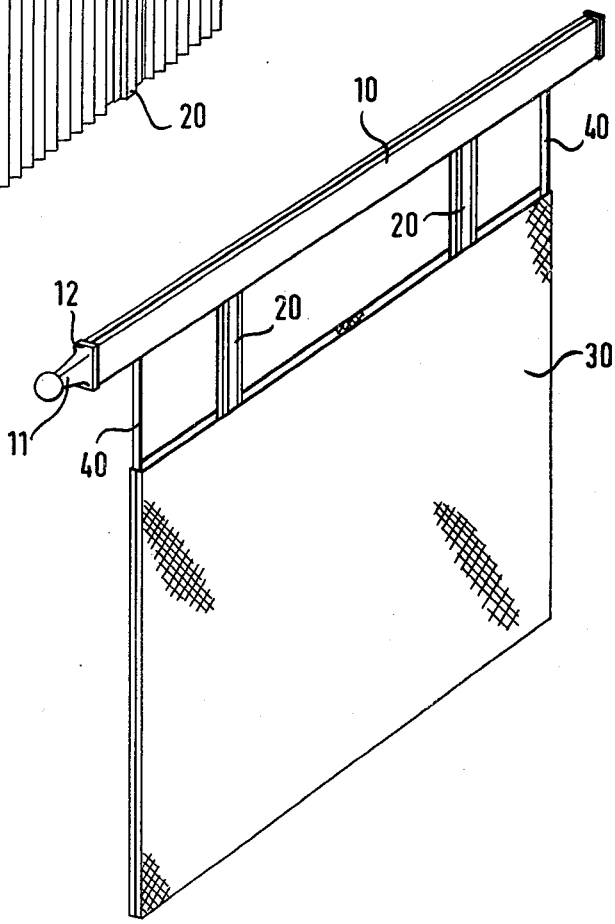
FIG. 19 shows also a perspective view of an electrode according to the invention.

FIG. 19 shows in perspective an expanded grid box electrode corresponding to FIGS. 8 and 9 with two current distributors 20 and respectively one terminal stiffening strut 40.

The type and construction of the electrodes according to the invention will be explained in more detail on the basis of the examples below.

EXAMPLE 1

To manufacture a current lead 10, on a 985 mm long, 50 mm wide, 15 mm high and 1.5 mm thick U-shaped titanium profiled sheet on the interior for a length of 500 mm corresponding to the extended length of the active portion an unrolled 30 mm wide titanium expanded grid strip is secured as the contact structure with a mesh length of 10 mm, a mesh width of 5 mm, a web thickness of 1 mm and a web width of 1 mm by spot welding. The spacing of the 10 mm long weld spots amounts to 30 mm. The U-shaped titanium profiled sheet thus made is overlapped with a second titanium profiled sheet of the same dimensions but without the welded titanium expanded grid strips and is welded together so as to be gastight and proof against liquid leaks to form a rectangular profiled jacket of 25 mm total thickness. The one front side of the rectangular profiled jacket is tightly sealed by a 3 mm thick welded titanium plate. Then on this titanium plate a contact head of copper is soldered using silver brazing solder. The current lead is now ready for filling with the core metal.

A current distributor is prepared in the same way with a 1150 mm long, 80 mm wide and 12 mm thick jacket of titanium in which however two titanium expanded grid strips are contained as the contact structure, i.e. there is one on each of the two U-profiles.

The current lead and distributor are heated to about 500° C. in a furnace in inert atmosphere. Into their open ends hot zinc liquified at 550° C. is then poured. After filling, bubble-free solidification, and cooling the filler ends of the jackets are freed of excess zinc and are cleaned. Now follows closing of the open ends of the jackets by welding on of titanium plates.

Along the two narrow sides of the current distributor, two coated active portions of dimensions 990×242 mm of 1 mm thick titanium sheet are welded with a corrugation length of about 24 mm, an amplitude of about 6 mm and a surface area ratio of total surface to projected surface of about 3.

The upper end of the current distributor projecting about 160 mm out of the corrugated sheet area is welded in the middle of the lower narrow side of the current lead to the latter.

The anode construction can be further fixed and stiffened by titanium connections between the current lead and the upper edge of corrugated sheet (see also FIG. 1).

The anode described is designed for a current of 390 A, corresponding to a current density on the anode side of 350 $A/m^2$. With a current of 390 A, there is only an ohmic voltage drop of about 50 mV in the anode.

The anode construction is stiff and robust. This results from the corrugated sheet structure and the current distributor described above.

The anode is simple in design, cheap to manufacture due to the small amount of titanium and the economical current lead and distributor with zinc core, and has a very large geometric surface. Without the copper contact head it weighs 20 kg, of which only 6 kg is accounted for by the costly material titanium.

Thanks to the favorable surface factor of 3, with this anode the current density on the anode side of 350 $A/m^2$ is reduced to a $D_A$ value (anodic current density) of about 235 $A/m^2$.

In the case of electrolytic zinc extraction, for which this anode is intended, an especially low oxygen excess voltage and cell voltage results from the above and from the catalytic effect of the active component of the coating over long periods in operation.

This anode has also been found very advantageous in the electrolytic extraction of manganese dioxide. The large surface of the anode available for separation with its surface factor of 3 and its extremely low inner voltage drop of about 18 mV with a current density on the anode side of 120 $A/m^2$ produce, apart from the quality improvements with electrolytic manganese dioxide, considerable energy savings per unit mass of product as well. Added to this is a substantial saving in specific labour costs per unit mass of manganese dioxide produced electrolytically, due to the easy removability of the $MnO_2$ coatings of this anode.

EXAMPLE 2

A modification of the anode design with current lead and current distributor, which is especially suitable for use in the electrolytic extraction of zinc at higher current loads with a current density on the anode side of 600 $A/m^2$, is made in the following way.

On a 985 mm long, 25 mm wide, 60 mm high and 1.5 mm thick U-shaped titanium profiled plate on the inside on the floor for a length of about 800 mm, a non-rolled 20 mm wide titanium expanded grid strip with the same grid characteristics as described in Example 1 is secured by spot welding. The spacing of the 10 mm high spot welds is 25 mm. The U-shaped titanium profile is welded by means of a 1.5 mm thick titanium sheet strip of suitable dimensions to a rectangular profile jacket to be gastight and proof against liquid leaks. The front side near the titanium contact structure of the rectangular profile jacket is tightly sealed by a 3 mm thick titanium plate of suitable dimensions which also has inside it a titanium expanded grid structure. The copper contact head has to be mounted on it. The filling of the current feed with zinc and the closing of the filler aperture are carried out as described in Example 1.

The active portion of this anode is a 1150 mm long, 565 mm wide, and 1 mm thick titanium corrugated plate of the same characteristics as in Example 1, but provided with two 1150 mm long and 60 mm wide, planar areas arranged in the middle of the two corrugated plate halves. In these planar areas non-rolled titanium expanded grid strips with contact coating are welded as described above. Due to the overlapping 1 mm thick titanium sheet strips, which are tightly welded on the corrugated peak edges abutting the planar areas on both sides, two current distributor jackets integrated in the active portion are formed. After filling in with zinc and the closing process, very functional current distributors are produced.

The thus coated corrugated plate anode, which can expediently have some boreholes to improve the electrolytic circulation, is then welded tightly with the current feed in the area of the current distributor ends, and in the other zones it is spot welded.

The ohmic voltage drop of this anode loaded with 670 A is only 50 mV. The two current distributors integrated in the active portion together with the welded current feed and the corrugated active portion form a very stiff, robust and durable construction utilising only a very small titanium quantity of about 6.5 kg per anode. The total weight of the anode is about 23.5 kg. The surface factor of 3 of the active portion produces a reduction of the current density on the anode side from 600 A/m$^2$ to a $D_A$ (anodic current density) of 400 A/m$^2$ which cuts down the cell voltage.

EXAMPLE 3

In copper extraction electrolysis using an anodic current density of 350 A/m$^2$ and a current loading of 590 A/anode, the following coated titanium anode has proven to be optimal.

The 1220 mm long titanium current feed jacket needed for this anode and the two 1170 mm long, 60 mm wide and 12 mm thick titanium current distributor jacket are designed as in Example 1.

The jackets of the current feed and of the two current distributors were heated in a furnace in inert atmosphere to about 750° C. Into the two open ends of the jackets liquified aluminum heated to 750° C. was then poured. After solidification and the cleaning of the filler apertures they were tightly welded with 3 mm thick titanium platelets.

The two current distributors were welded in a 990 mm high, 852 mm wide and 14 mm thick coated titanium expanded grid box open at top and bottom with grid characteristics mesh length 31.75 mm, mesh width 12.7 mm, web width 2.46 mm, web thickness 1.0 mm in the middle of the respective box halves on the total height of the box to it. The current feed was welded by its narrow side onto the upper 180 mm long current distributor ends projecting out of the box. The anode assembly was additionally fixed and reinforced by connector strips of titanium between the current feed jacket and the top corners of the box.

The titanium weight of this anode is 6 kg, its total weight is 13.2 kg. Despite this small consumption of titanium, the ohmic voltage drop of this anode is only 35 mV.

As the jacket for the current-carrying component according to the invention, triangular, rectangular, trapezoidal, as well as other polygonal profiles, corrugated sheet box profiles, tubes or the like are all suitable. The wall thickness of the jacket of the current-carrying component can vary between 0.5 mm and some mm. The jacket consists of one of the valve metals already mentioned. If the jacket of the current-carrying component is assembled from two or more profiled parts and the latter are welded together, the welded seams have to be both gastight and proof against liquid leaks.

The contact structure provided using the current-carrying components according to the invention can have a spatial structure with surfaces oriented in several directions, which is surrounded by the core metal from several directions. A spatial structure of this type will be flowed round and/or surrounded from several directions when pouring in the core metal by the latter, so that during the solidifying process the core metal will shrink internally onto the spatial structure from several sides.

In this manner a large-area and trouble-free compound between the core metal and the contact structure is ensured. The problems raised by a metallurgical compound between the core metal and the jacket metal are therefore substantially avoided.

The contact structure with its large surface has a small volume when measured by the volume of the core metal.

The same effect is caused when the contact structure is formed by a plurality of bodies such as bolts 62 with thickenings **62*b* and/or thinnings 62*a***. These bolts can be extended perpendicularly to the direction of current flow, but also at any other angle to each other and to said current flow. The only decisive point is that these bodies must have an adequate volume and/or adequate cross-section to produce on the one hand a good electrically conductive connection with the lowest possible voltage drop to the core metal and to the jacket metal on the other hand, so that even high currents can be transferred with low voltage drop from the core metal to the jacket metal and further to the active surfaces of the metal anodes. The number and cross-section of the welds between the contact structure and the jacket are determined by a predetermined and reliable voltage drop.

To further reduce the electrical transfer resistance between the core metal and the contact structure, the latter can be provided with a suitable contact coating. This is an advantage with a relatively small-area contact structure or with particularly highly electrically-loaded current-carrying components. As the contact coating the usual materials employed in the electrical industry can be considered, to the extent that they are compatible with the respective metal of the core. The precious metals and/or their oxides and/or the base metals and their electrically conductive substoichiometric or dosed oxides can be used as the materials.

As casting metal for making the core of a current-carrying component of an electrode according to the invention, suitable metals are those with melting points at least 500° C. lower than that of the metal of the jacket of the current-carrying component. The core metal should moreover have a substantially higher electrical conductivity than the valve metal of the jacket, e.g. titanium. Considering these demands, for example zinc, aluminum, magnesium, tin, antimony, lead, calcium, copper or silver and corresponding alloys can be used as the core metal. Of course, the choice of the metal for the core must also meet the special demands of the respective metal extraction process. Thus, e.g. in zinc electrolytic extraction, metallic zinc has given excellent results as core metal with its low melting point of 420° C. and its good specific electrical conductivity of $156\times10^3$ ohm$^{-1}$ cm$^{-1}$.

In the event of a short circuit, metallic zinc also has the advantage that its corrosion products influence neither the hydrogen excess voltage of the cathode nor the purity of the separated cathode zinc.

Also in the extraction of copper with electrodes according to the invention, zinc has proven to be suitable as the core metal for the current-carrying components. But here aluminum, magnesium, or lead as well as the corresponding alloys can also be considered.

With known electrodes it is often not possible to choose the metal of the core in accordance with the special needs of the metal extraction process. The connection of titanium sheathed copper as the active portion and/or current lead and distributor, as used in the known solutions, is not tenable in most metal extraction processes, since during electrolysis, due to dendrite formation of the cathodically separated metal, short circuits often occur which may destroy the titanium jacket. It is known that copper and alloy metal released by short circuits dissolve anodically. The metal ions formed are deposited on the cathode, foul the product and moreover influence the hydrogen excess voltage and thus the current yield of the metal extraction process. This produces an unsaleable cathode metal which is impure and is produced due to the lower current yield at high cost. Here it must be mentioned that a single short circuit e.g. during electrolytic zinc extraction may negatively influence a plurality of cathodes. Titanium plated copper with metallurgical compound appears to be economically unsuitable even in electrolytic copper extraction due to the high rate of short circuits and the high rod prices.

An especially advantageous further embodiment of the invention arises when the component acting as the current distributor is integrated in the active surface of the electrode in that the jacket is at least partially formed by an electrode plate constituting the active surface of the electrode and a contact structure is arranged in such a current-carrying component.

This construction ensures that an especially compact electrode results which is remarkable for its small thickness. This not only permits an especially space-saving cell, but it means that insertion and removal of the electrodes into or out of such a cell is particularly free of problems.

It is true that an electrode for metal extraction is already known (U.S. Pat. No. 4,260,470) in which the active surface is formed by vertically arranged plates which overlap wherein in the overlapping areas respectively a cavity extending parallel to the plate extension is formed, e.g. by the U-shaped bending of an overlapping area of a plate. A metal is poured into this cavity.

Moreover rods carrying current are embedded in the poured metal which are connected with a horizontal current-carrying rail. But this poured metal serves primarily as a stiffening of the active surface of the electrode, which consists of flat plates. Only secondarily does the poured metal serve as the electrical connection of the rods embedded therein with the active surface of the electrode. These rods are not comparable with the contact structure according to the invention because they do not form a structure onto which the poured metal is shrunk. Correspondingly the current-carrying rods are not directly connected with the jacket of the current-carrying component or with the corresponding area of the electrode plate themselves, as in the contact structure according to the invention.

Lastly there are problems which have been explained in connection with the shrinking of poured metal.

With the electrode according to the invention, it is advisable that the contact structure should be welded with the area of the electrode plate which at least partially forms the jacket, since hereby a direct transfer of the current from the core metal of the current-carrying component to the active electrode surface results.

To form a cavity to be filled with the core metal for the current-carrying component integrated into the active surface, it is expedient that at least the area partially forming the jacket of the electrode plate should be U-shaped or sinuous and that this area should be supplemented by a cover plate for the closed jacket. The cavity formed thereby within the jacket can be filled with suitable core metal in the manner described above which closely connects with the contact structure.

The said cover plate which can have any form desired is expediently welded with the electrode plate to be gastight and proof against liquid leaks.

In a further embodiment of the invention the active surface of the electrode is formed by a plurality of profiled rods arranged in one plane parallel to each other and forming the contact structure by sections of said profiled rods, while the contact structure is led through the core of the current-carrying component.

This embodiment differs from the known electrode according to the U.S. Pat. No. 4,260,470 in that in the electrode according to the invention the sections of the profiled rods which are led through the current-carrying component or its core are welded with the jacket. In this way, there is a direct connection of the sections used as contact structure of the profiled rods with the active electrode surface, resulting in a good transfer of the current. Moreover the sections of the profiled rods which act as the contact structure can be formed as regards their surface or form so that they meet the demands placed on the structure. They may also have a contact coating.

Thus, briefly summarized, the invention provides an electrode using a current-carrying component which consists of a jacket of metal and a core arranged therein of metal which is a good electrical conductor, the core metal of the current-carrying component having embedded therein a contact structure, consisting of metal which is connected by a plurality of welds with the internal surface of said jacket.

As a result of this design of the electrode, and especially of its current-carrying component, a good electrically conductive connection results between the core metal and the jacket metal with the consequence that the voltage drop is reduced, even at high applied voltage and large currents. The inner contact thus attained between the contact structure and the core metal remains intact over long operating periods, even in the presence of great temperature fluctuations. Moreover, the contact structure improves the mechanical strength of the correspondingly designed current-carrying component and thus of the metal electrode. The electrode can be made cheaply and economically because the difficulties in the known arrangements of the metallurgical connection of the core metal with the jacket metal and/or the insertion of an intermediate layer of suitable material, e.g. of a material which is liquid at operating temperatures, do not arise. When manufacturing the electrode the core metal can in fact be simply poured in the liquid state into the interior of the jacket. Due to the corresponding design of the contact structure, the core metal flows round the contact structure internally and shrinks onto it with initial force. Thus the desired inner contact between the core metal and the contact structure is attained. The contact structure in turn is welded for good electrical connection with the interior of the jacket.

I claim:

1. An electrode for the electrolytic extraction of metals or metal oxides, having an electrically conductive member which comprises a jacket of metal; a substantially solid core of metal which is a good electrical conductor arranged in electrically conductive connection with said jacket; and a metallic contact structure which is embedded in the core metal, and is connected by welding to an inner surface of said jacket.

2. An electrode according to claim 1 wherein said jacket and said contact structure are of valve metal.

3. An electrode according to claim 1 wherein the contact structure is spatially extended with surfaces oriented in several directions and is surrounded from several directions by said core metal.

4. An electrode according to claim 1 wherein the contact structure is formed of a strip of expanded metal, wire netting, or perforated plate.

5. An electrode according to claim 4 wherein said strip is disposed parallel to the current flow direction in the component.

6. An electrode according to claim 5 wherein said strip extends in a straight line.

7. An electrode according to claim 5 wherein said strip extends sinuously.

8. An electrode according to claim 3 wherein said contact structure is formed of at least one wire which is disposed sinuously along the current flow direction.

9. An electrode according to claim 3 wherein said contact structure consists of a plurality of bodies having enlargements or recesses.

10. An electrode according to claim 1 wherein said contact structure is provided with a coating of a substance for reducing contact resistance.

11. An electrode according to claim 1 wherein the core of the current-carrying component consists of a metal whose melting point is lower by at least 500° C. than the melting point of the metal of said jacket.

12. An electrode according to claim 1 wherein the metal of said core has a substantially higher electrical conductivity than the metal of said jacket.

13. An electrode according to claim 1 wherein there is provided an active portion which is integrated with said electrically conductive member in that said jacket is at least partially formed by an electrode plate which constitutes the active portion of said electrode.

14. An electrode according to claim 13 wherein the contact structure is welded to an area of the electrode plate which forms at least part of said jacket.

15. An electrode according to claim 13 wherein at least that area of the electrode plate forming part of said jacket is U-shaped or corrugated and is supplemented by a cover plate of said jacket.

16. An electrode according to claim 15 wherein the cover plate is welded to the electrode plate.

17. An electrode according to claim 13 wherein the electrode plate is formed as a corrugated sheet.

18. An electrode according to claim 13 wherein the electrode plate is welded on both sides to said jacket.

19. An electrode according to claim 1 wherein there is provided an active portion formed by a plurality of parallel profiled rods and the contact structure is formed by sections of the profiled rods which extend through said core.

* * * * *